US005535682A

United States Patent [19]

Aigeldinger

[11] Patent Number: 5,535,682

[45] Date of Patent: Jul. 16, 1996

[54] UTILITY TABLE

[76] Inventor: Ralph Aigeldinger, 14 Braxton Rd., Rosemont, Pa. 19101

[21] Appl. No.: 316,874

[22] Filed: Oct. 3, 1994

[51] Int. Cl.[6] ..... A47B 97/00

[52] U.S. Cl. ..... 108/25; 108/129

[58] Field of Search ..... 108/25, 26, 28, 108/129, 42, 43, 44, 45, 46, 47, 49, 26.2

[56] References Cited

U.S. PATENT DOCUMENTS

| | | | |
|---|---|---|---|
| 1,627,454 | 5/1927 | Phalon | 108/129 X |
| 1,972,202 | 9/1934 | Purves | 108/26.2 |
| 2,723,037 | 11/1955 | Matesic | 108/44 X |
| 3,039,616 | 6/1962 | Proffit | 108/46 X |
| 3,238,953 | 3/1966 | Barbie | 108/144 X |
| 3,804,031 | 4/1974 | Pitts | 108/44 |
| 3,817,190 | 6/1974 | Evangelista | 108/44 |
| 4,177,737 | 12/1979 | Brickman | 108/25 X |
| 4,312,507 | 1/1982 | Smith et al. | 108/25 X |
| 4,972,781 | 11/1990 | Montgomery et al. | 108/25 |
| 5,055,081 | 10/1991 | Nayak | 108/26 X |

FOREIGN PATENT DOCUMENTS

| | | | |
|---|---|---|---|
| 653871 | 3/1929 | France | 108/25 |
| 50920 | 5/1941 | France | 108/46 |

*Primary Examiner*—Peter M. Cuomo
*Assistant Examiner*—Janet M. Wilkens
*Attorney, Agent, or Firm*—Frederick J. Olsson

[57] ABSTRACT

A utility table having a top and foldable legs. The top has openings. On the underside of the top, flexible strips extend across the respective openings. Each opening and strip form an open-sided pocket for drinking containers. The folding of the legs up against the top is accommodated by the flexible strips being gathered between the legs and the top.

4 Claims, 1 Drawing Sheet

UTILITY TABLE

This invention relates to out-of-door furniture.

More specifically the invention relates to a small, short-height utility table which can instantly be converted to an inactive mode where it is set up for storage and transporting or instantly converted to an active mode wherein it is set up to receive small items used for picnics and similar leisure activities.

The invention finds particular utility for use at beaches, pool sides, sun-decks, and on lawns where it can be placed next to a chair and function as a service table. The table is constructed to hold various types of drinking containers in a non-tip condition and other items such as pens, pencils, small radio, etc. in a non-sliding or non-roll away condition and additionally provides a service platform for writing pads, books, lunch boxes, and the like.

In its broadest aspect the invention contemplates a low level table having pivotable legs which provide for the table to set up for storage or transport or set up on a beach, deck, etc., the table having several openings with flexible material underneath each opening which constitutes a bottom support for a drinking container disposed in the opening and supported against tipping by the edge of the opening, the flexible material also constituting a collapsible medium accommodating the leg position for storage.

The invention will be described below in connection with the following drawings wherein.

Figure 1:
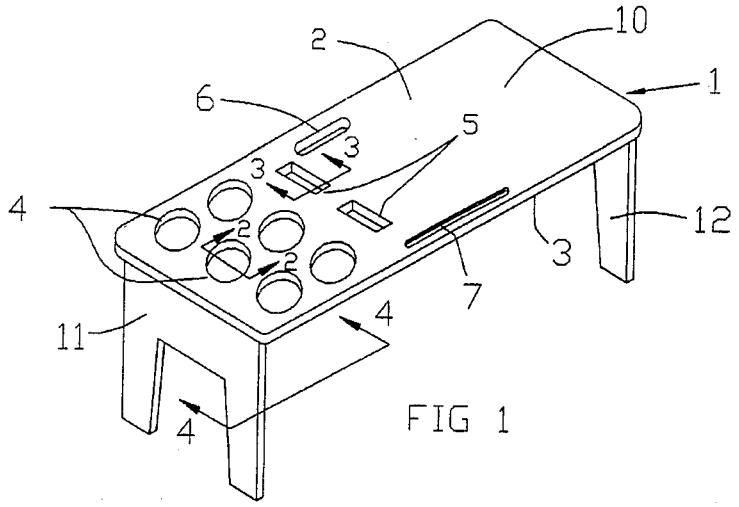
FIG. 1 is a perspective view of a utility table constructed in accordance with the invention.

In FIG. 1 a table top member 1 has a topside surface 2 and an underside surface 3.

A plurality of circular opening 4 each extend through the top member 1 between the top and underside surfaces 2 and 3. A plurality of rectangular shaped openings 5 adjacent the openings 4 also extend through the top member 1 between the top and underside surfaces 2 and 3. Along one edge of the top member 1 is an elongated opening 6 which extends through the top member 1 between top and underside surfaces 2 and 3.

The opening 6 is dimensioned to receive the fingers of the hand.

Along the opposite edge is a slot 7 which does not go clear through the top member.

The circular openings 4 are dimensioned to receive liquid containers such as paper cups and bottles. A diameter of approximately 3 inches is good compromise to hold a wide variety of such conventional liquid containers.

The rectangular openings 5 are dimensioned to receive playing cards and the like. The slot 7 is dimensioned to receive pencils, pens and the like. The area 10 on the top surface 2 is free from openings and can serve as a service platform for writing pads, books, bags, and the like.

First and second leg means 11 and 12 are pivotally connected to the underside surface 3 so that each leg means can pivot as between an active mode as shown in FIG. 1 to an inactive mode wherein each leg means is up adjacent the underside surface 3.

In the embodiment illustrated in FIG. 1, the top member 1 and the leg means 11 and 12 are fabricated from plywood using conventional tools.

In the active mode the utility table can be set down on beach sand, a deck surface, and the like to receive any or all of the various items mentioned. Preferably the table is low level so that when placed beside a chair the top surface 2 is readily within reach. The leg means 11 and 12 are dimensioned so that when placed down on the sand, etc. the top surface 2 is preferably about 11 inches above the sand or deck.

In the inactive mode, the leg means 11 and 12 are each folded up adjacent the underside surface 3 so that assembly is essentially flat. This enables the table to be stored without taking up a lot of space and to be hand transported by using the slot 7.

An important feature of the invention is the use of flexible means to functioning as a bottom for the openings 4 and 6 so to hold the items mentioned while at the same time functioning as a collapsible medium to permit the legs to be folded to place the table in the inactive mode.

Preferably, the flexible means mentioned above is in the form of a woven flexible strip 13 about 2½ inches wide and fabricated from fabric or plastic.

Figure 2:
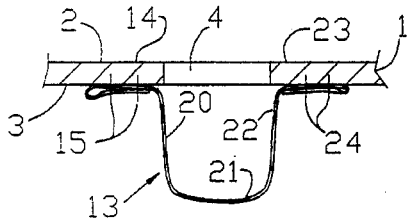
FIG. 2 is a view taken along the lines 2—2 of FIG. 1.

Referring to FIG. 2, the flexible means (in the form of strip 13) is connected to the underside surface 3 in the section or area 14 next to the opening 4. The connection is made by folding back the end of the strip and stapling the same to the top as by the staples 15. The strip extend downwardly from the opening 4 as indicated at 20, thence across the opening as indicated at 21 and thence upwardly as indicated at 22 to the section or area 23 wherein the end is folded back and attached by staples 24.

While I have shown the strip as being in a non-taut condition, it will be understood that when a full container is placed in an opening 4 the bottom of the container engages the strip part,indicated at 21, the strip will be taut.

It will be apparent that placing a container in the opening as described places the same in a non-tipping condition since engagement with the edge of the opening stops any such motion. Also, the bottom of the container cannot slide out because of the width of the strip and because the edge engagement just mentioned.

Figure 3:
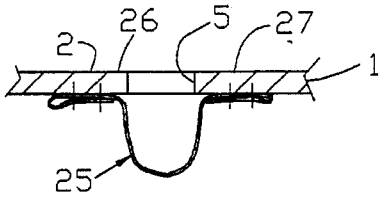
FIG. 3 is a view taken along the lines 3—3 of FIG. 1.

FIG. 3 shows one of the rectangular openings 5 with a flexible strip 25 attached at 26 and 27 similarly as described for the strip 13.

For top fabrication purposes, if it is desired to make the slot 7 extend clear through the top 1, the invention contemplates making the slot bottom by the use of a strip disposed on the underside and covering the slot 7 and stapled in position.

Figure 4:
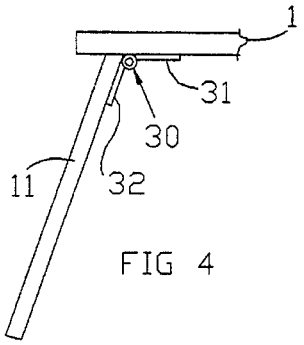
FIG. 4 is a fragmentary view showing the position of the legs for placing the table in the active mode.
Figure 5:
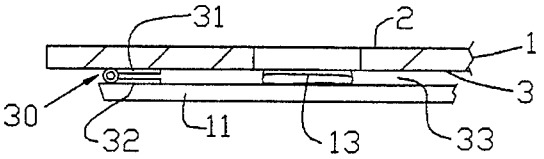
FIG. 5 is a fragmentary view showing the position of the legs for placing the table at an inactive mode.

FIGS. 4 and 5 shown the pivot connection for leg first means 11 and with the leg means rotated for the active mode and inactive modes. The pivot 30 is in the form of hinge means one leaf 31 of which is screwed to the underside surface 3 and the other leaf 32 is screwed to the top of the leg means 11. The hinge means may be a single elongated piece or two smaller, spaced apart pieces.

In FIG. 5, the first leg means 11 has been rotated upwardly adjacent the underside surface 3 for the inactive mode.

In the rotation of leg means 11 to the inactive mode, the leg means engages one or all of the various strip means. But since each strip means is flexible, it collapses and is gathered or compacted between the underside surface 3 and the leg means 11 in the space indicated at 33.

Figure 6:
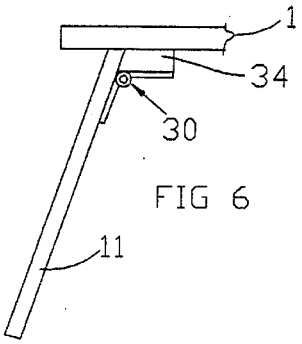
FIGS. 6 and 7 are views similar to FIGS. 4 and 5 illustrating an alternative way of mounting the legs.
Figure 7:
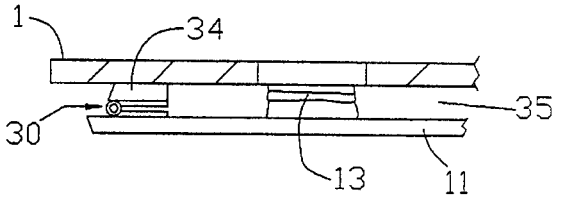

In the event the gathering of compacting of the strip means when the legs are folded results in the top 1 and the leg means to be undesirably nonparallel, the invention contemplated additional space been the underside surface 3 and the leg means. This is shown in FIG. 6 and 7. The pivot means 30 is mounted on a spacer 34 secured to the underside surface 3. When the leg means 11 is rotated to the inactive mode, the additional space 35 is provided between the leg means 11 and the underside surface 3.

I claim:

1. A top for a utility table, comprising:

a flat top member made of wood and having a top surface and an underside surface;

at least one opening extending through said top member between the top and underside surfaces;

an elongated, flexible strip;

said elongated flexible strip being stapled to said underside surface in a first position adjacent said opening;

said elongated flexible strip being stapled to said underside surface in a second position adjacent said opening and opposite to said first position;

said elongated flexible strip extending in a direction away from said first position and thence in a direction across said opening and thence in a direction toward said second position; and said opening and said strip forming an open-sided pocket to receive a drinking container.

2. A top for a utility table, comprising:

a flat top member made of wood and having a top surface and an underside surface;

a plurality of openings each extending through said top member between the top and underside surfaces;

for each said opening:

(a) an elongated flexible strip;

(b) the elongated flexible strip being stapled to said underside surface in a first position adjacent its opening;

(c) the elongated flexible strip being stapled to said underside surface in a second position adjacent its opening and opposite to said first position;

(d) the elongated flexible strip extending in a direction away from said first position and thence in a direction across its opening and thence in a direction toward said second position;

said openings being disposed in said top member to provide a clear area on the top surface which constitutes a service platform; and said openings and strips respectively forming open-sided pockets to receive drinking containers.

3. A utility table comprising:

a flat top member made of wood and having a top surface and an underside surface;

at least one opening extending through said top member between the top and underside surfaces;

an elongated flexible strip;

said elongated flexible strip being stapled to said underside surface in a first position adjacent said opening;

said elongated flexible strip being stapled to said underside surface in a second position adjacent said opening and opposite to said first position;

said elongated flexible strip extending in a direction away from said first position and thence in a direction across said opening and thence in a direction toward said second position, first flat leg means made of wood;

first hinge means having leaves respectively connecting said first leg means to the underside surface of said top member for pivoting motion as between an active position and an inactive position;

screw means connecting said leaves respectively to said leg means and to said underside surface;

in said active position, the first leg means extending away from said underside surface;

in said inactive position, the first leg means extending along, adjacent to and spaced from said underside surface and at least part of said elongated flexible strip being gathered within the space between the first leg means and the underside surface;

second flat leg means made of wood;

second hinge means having leaves respectively connecting said second leg means to the underside surface of said top member for pivoting motion as between an active position and an inactive position;

second screw means connecting said leaves respectively to said leg means and said underside surface;

in said active position, the second leg means extending away from said underside surface;

in said inactive position, said second leg means extending along, adjacent to and spaced from said underside surface; and said openings and strips respectively forming open-sided pockets to receive drinking containers.

4. The utility table of claim 3 wherein:

in said inactive position of said second leg means, at least part of said elongated, flexible strip being gathered within the space between the second leg means and the underside surface.

* * * * *